US008449070B2

(12) United States Patent
Greeven

(10) Patent No.: US 8,449,070 B2
(45) Date of Patent: May 28, 2013

(54) MANAGING FLUID WASTE SOLIDS

(75) Inventor: John C Greeven, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 194 days.

(21) Appl. No.: 12/746,449

(22) PCT Filed: Dec. 18, 2007

(86) PCT No.: PCT/US2007/025904

§ 371 (c)(1),
(2), (4) Date: Jun. 4, 2010

(87) PCT Pub. No.: WO2009/078841

PCT Pub. Date: Jun. 25, 2009

(65) Prior Publication Data

US 2010/0265295 A1 Oct. 21, 2010

(51) Int. Cl.
*B41J 2/165* (2006.01)

(52) U.S. Cl.
USPC ..... 347/36; 347/89; 347/85; 347/90

(58) Field of Classification Search
USPC ..... 347/29, 35, 36, 85, 89, 90, 92, 93
See application file for complete search history.

(56) References Cited

U.S. PATENT DOCUMENTS

| | | | | |
|---|---|---|---|---|
| 3,218,175 | A | 11/1965 | Siegel et al. | |
| 4,204,215 | A | 5/1980 | Nakarai | |
| 4,223,323 | A | 9/1980 | Bader et al. | |
| 4,278,984 | A | 7/1981 | Matsumoto et al. | |
| 4,388,630 | A | 6/1983 | Osaki et al. | |
| 4,771,295 | A | 9/1988 | Baker et al. | |
| 5,497,700 | A * | 3/1996 | Herb | 101/153 |
| 5,942,095 | A * | 8/1999 | Day et al. | 204/553 |
| 6,155,679 | A * | 12/2000 | Sato | 347/92 |
| 6,183,076 | B1 | 2/2001 | Childers et al. | |
| 6,364,471 | B1 | 4/2002 | Seccombe | |
| 7,118,206 | B1 * | 10/2006 | Stockwell et al. | 347/92 |
| 7,665,824 | B2 * | 2/2010 | Riou et al. | 347/34 |
| 2001/0017997 | A1 * | 8/2001 | Saitoh | 399/250 |
| 2004/0048183 | A1 * | 3/2004 | Teshima | 430/137.1 |
| 2004/0100521 | A1 * | 5/2004 | Rotering | 347/36 |

OTHER PUBLICATIONS

International Search Report. International Application No. PCT/US2007/025904. Filing date Dec. 18, 2007. Date of mailing Sep. 9, 2008.

* cited by examiner

*Primary Examiner* — Matthew Luu
*Assistant Examiner* — Henok Legesse

(57) ABSTRACT

Among various embodiments of the present disclosure, managing substantially solid materials in fluid waste can be performed by collecting the fluid waste in an accumulator. In various embodiments, the accumulator can be configured by positioning a number of input orifices for the fluid waste in a top region of a vertically oriented cavity in the accumulator, and positioning a number of output orifices in a bottom region of the vertically oriented cavity in the accumulator. As such, a flow of the fluid waste can contribute to transport of substantially solid material in the fluid waste from the top region into the bottom region and from the bottom region into at least one output orifice.

20 Claims, 6 Drawing Sheets

MANAGING FLUID WASTE SOLIDS

An accumulator may, in some implementations, be used for storing a vacuum that can, for instance, contribute to priming of printheads in a printing apparatus prior to execution of a print job. In such a situation, the accumulator may use the vacuum to draw excess fluid (e.g., colorant containing pigment, dye, etc.) from print nozzles of the printheads. Such excess fluid can be drawn into the accumulator prior to disposal as fluid waste. Removing the excess fluid from the nozzles of the printheads may, among other effects, prevent deposition of substantially solid material (e.g., viscous remnants of partially evaporated colorant, precipitates of pigments, among other causes) in and/or around the nozzles.

However, in some instances, the substantially solid material in the fluid waste may be deposited in the interior of the accumulator, and/or inside/around/near input and/or output orifices thereof, prior to being removed therefrom along with the fluid waste. As such, the deposited solids may reduce the interior volume of the accumulator and/or affect the flow of fluid and/or gas through the orifices.

Reducing the interior volume of an accumulator and/or affecting the flow of fluid and/or gas through the orifices thereof may, for instance, affect the intensity of a vacuum stored therein such that a pressure differential used to remove excess fluid from the nozzles of the printheads is outside intended design limits. Hence, deposition of substantially solid material in an accumulator, within, around, and/or near orifices thereof, and/or in associated tubing utilized for fluid and/or gas flow may, among other effects, affect the priming of the printheads, possibly contributing to premature failure thereof.

DETAILED DESCRIPTION

Figure 1:
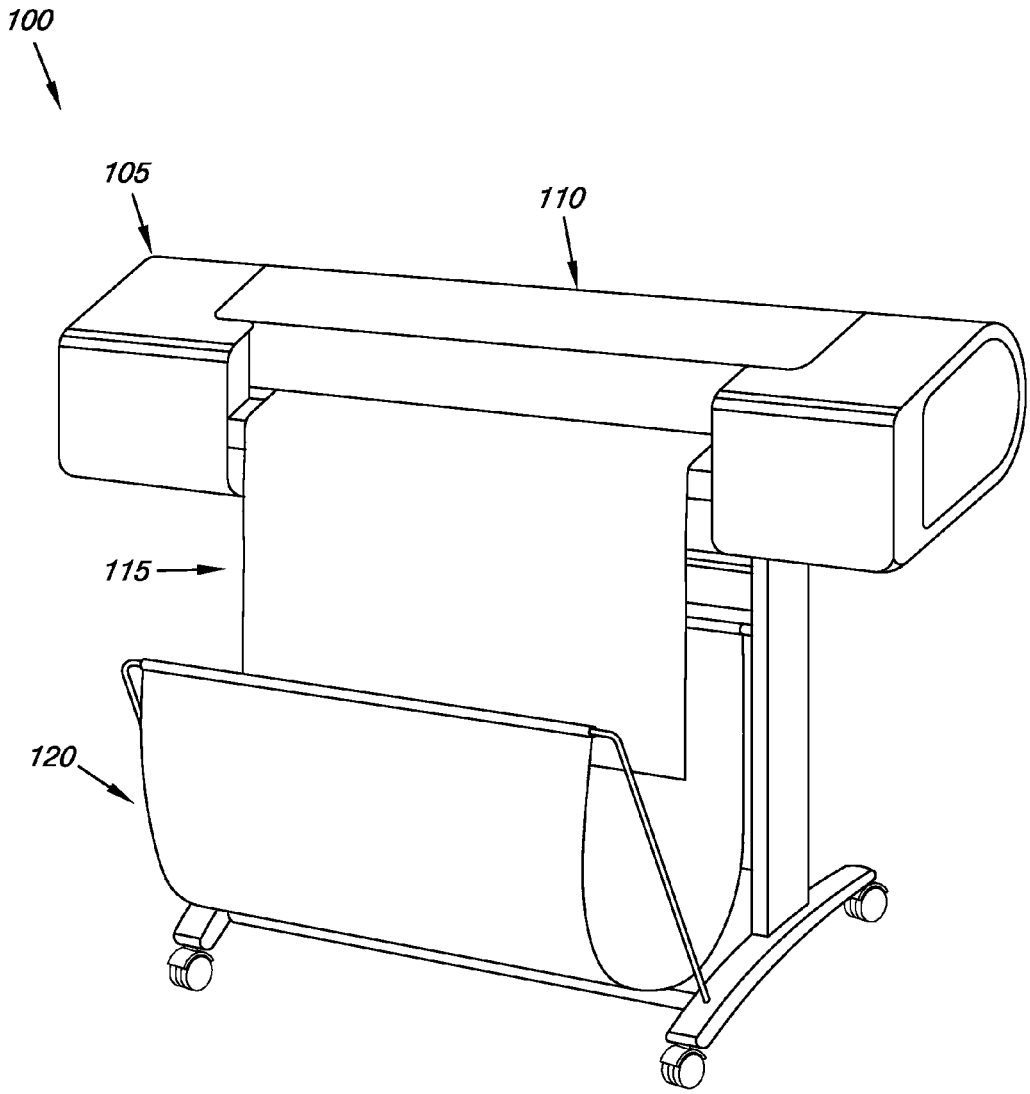
FIG. 1 illustrates an example of a printing device suitable for managing solids in fluid waste according to embodiments of the present disclosure.

The present disclosure describes an accumulator device that can be used for managing substantially solid materials in fluid waste, along with methods of using and controlling same. Various embodiments of the present disclosure enable collection of fluid waste through one or more input orifices at or near a top of an accumulator that has a vertically oriented enclosed cavity within the accumulator (e.g., a hollow upright cylinder).

Due to gravity and/or a force imparted by a pressure differential between a source of the fluid waste and the interior of the accumulator, the fluid waste tends not to remain associated with the top of the accumulator and/or the orifices associated therewith. Hence, substantially solid materials contained in the fluid waste also tend not to remain associated with the top of the accumulator and/or the orifices associated therewith.

The fluid waste can drop and/or be carried toward a bottom of the accumulator, thereby also carrying the substantially solid material toward the bottom. One or more output orifices can, in various embodiments of the present disclosure, be positioned at and/or near a bottom location of the accumulator. The one or more output orifices associated with the bottom location can contribute to removal of the substantially solid material in the fluid waste through the one or more output orifices prior to deposition in and/or near the input orifices and/or upon an interior wall of the accumulator.

In some embodiments, the one or more bottom orifices can be positioned at and/or near a bottom of one or more substantially conical sections of a bottom region connected to the vertically oriented enclosed cavity. Hence, each conical section can serve as a funnel directing the substantially solid material toward and through the associated output orifice, while deterring deposition of the substantially solid material on the one or more substantially conical sections and/or on the one or more bottom orifices.

Accordingly, among various embodiments of the present disclosure, management of substantially solid materials in fluid waste can be performed by collecting the fluid waste in an accumulator as described in the present disclosure. Such an accumulator can, in various embodiments, be configured by including a number of input orifices for the fluid waste positioned in a top region of the vertically oriented cavity in the accumulator, and including a number of output orifices for substantially solid material in the fluid waste positioned in a bottom region of the vertically oriented cavity in the accumulator. As such, a flow of the fluid waste can contribute to transport of substantially solid material in the fluid waste from the top region into the bottom region and from the bottom region into at least one output orifice.

Among a variety of implementations in which an accumulator as described in the present disclosure may be used to reduce deposition of substantially solid material from fluid waste, collection of fluid waste in such an accumulator can, in various embodiments, be used for collecting colorant in the accumulator from a number of printheads of a printing device. In some embodiments, collecting colorant in the accumulator from the number of printheads can contribute to priming the number of printheads for subsequent printing of a print request.

FIG. 1 illustrates an example of a printing device suitable for managing solids in fluid waste according to embodiments of the present disclosure. As one of ordinary skill in the relevant art will appreciate, embodiments of the present disclosure are not limited to inclusion with or implementation on a printing device as illustrated in FIG. 1.

FIG. 1 illustrates an embodiment of a printing device 100. The printing device 100 illustrated in the embodiment of FIG. 1 can operate as a stand alone device and/or can be used as a printing device in an imaging system.

FIG. 1 illustrates an embodiment of the printing device 100 that can use nominal values stored in a color map, which can include one or more one-dimensional (1D), two-dimensional (2D), and/or three-dimensional (3D) look-up tables (LUTs), among other embodiments, to print color images, including color characters, on a print medium (e.g., paper and/or transparent film, among others).

The printing device 100 can use image data on which halftoning using available colorants to render pixels in a, for example, rasterized image can be performed. Other examples of output devices include color copiers, color multi-function-peripherals, and color multi-functional printers, among other apparatuses.

The printing device 100 illustrated in FIG. 1 can have memory coupled thereto, where executable instructions can, in various embodiments, be stored for execution by a processor. One example is memory having instructions for using a priming system that includes an accumulator that is usable in association with a print engine. In various embodiments, the printing device 100 can include a number of inputs to receive instructions to be stored in the memory and/or a number of inputs for instructions that have been coded and stored, for example, on one or more preconfigured firmware units, among other sources.

In various embodiments, the printing devices in the present disclosure can receive source image data associated with pixels in alphanumeric character text, image, symbol documents, and/or documents having a combination of such elements. In addition, embodiments can receive source image data from various sources.

For instance, embodiments of printing devices can receive source image data from a number of apparatus types (e.g., a telecommunication apparatus, a telefaxing apparatus, a computing apparatus, a copying apparatus, and/or a scanning apparatus, among others) that can be connected to the embodiment of the printing device 100 illustrated in FIG. 1. In some embodiments, all of the just-mentioned functionalities can be included in an All-In-One (AIO) system having an associated (e.g., embedded) image processing apparatus that can contribute to performing the functions described herein.

Printing devices included in the present disclosure can use various printing techniques. Printing devices, for example, can print on a print medium by using techniques for applying a colorant onto a print medium, such as firing drops through nozzles of inkjet pens and/or by using color toner and a laser. Various embodiments of printers, including inkjet and laser printers, can print color images, including color characters.

Printing devices as described in the present disclosure can also use a number of various colorants in printing. Printing devices can use, for example, three, four, six, or another number of colorants in various combinations in printing.

In various embodiments, a printing device as described in the present disclosure can use a number of colorants for printing on a number of print media that are formulated using one or more dyes, pigments, and combinations of each, among others. Such colorants can be combined, in various embodiments, for use in reactive ink systems and/or pigmented ink systems, among others. Embodiments of the present disclosure can be used for managing substantially solid and/or viscous materials that form in printheads and/or nozzles thereof of printing devices that use such colorants and/or ink systems, among other implementations outside of a printing device.

Printing devices can, for example, use colorants such as C, M, and Y. In some embodiments, the C, M, and Y colorants (CMY) can be used along with additional colorants, for example, a black (K) colorant. In such embodiments, a printing device can print using colorants, such as CMYK, in which black and non-black colorants can be used in various combinations to produce composite image pixels displaying various shades of gray and/or any other colors available in a color map installed on the printing device.

Some printing device embodiments can print using non-black colorants, such as CMY, in which such non-black colorants can be combined in an attempt to produce black and shades of gray, including a neutral balanced gray, among other colors, in a printed color image.

A printing device as described in the present disclosure can produce a test sample on a print medium, the characteristics of which (e.g., color, lightness, hue, saturation, chromaticity, granularity, definition, among others) can be visually compared to, and/or measured in comparison with, a number of reference samples and/or viewer preferences in order to ascertain whether printheads and/or nozzles thereof are suitable for priming. In some embodiments, instructions stored in and/or used by a printing device can cause the print device to execute priming of the printheads and/or nozzles thereof prior to beginning a print job.

FIG. 1 illustrates, by way of example and not by way of limitation, an embodiment of a printing device 100 suitable for use with various embodiments of the present disclosure in which the printing device 100 is a large format printing device. In some implementations, a large format printing device 100 as illustrated in FIG. 1 (e.g., a Hewlett-Packard Designjet T1100 series printer) can be utilized by professionals and/or commercially for printing large maps, posters, advertisements, artwork, signs, among other uses. Other formats of printing devices also can be suitable for use with embodiments of the present disclosure, for example, a printing device for a personal computer, among others.

In the embodiment illustrated in FIG. 1, the large format printing device 100 can include a chassis 105 that houses and/or supports operative, decorative, and/or user interactive components, as will be appreciated by one of ordinary skill in the relevant art. Among the components that can be housed in and/or supported by the chassis 105 are one or more print engines 110. The one or more print engines 110 can include a number of components for printing on a large format print medium 115. After having a number of images printed thereon, the large format print medium 115 can, in various embodiments, be collected in a receiving component 120 for one or more sheets of large format print medium 115.

Components of the one or more print engines 110 can include, among others, printheads having nozzles for applying colorant to, and printing on, the large format print medium 115 and a priming system (not shown) for preparing the printheads and/or nozzles thereof for such printing and/or maintaining the printheads and nozzles thereof in such condition. In various embodiments, the priming system can include an accumulator (not shown) associated with a motor (not shown), for example, serving as a pump to create a partial vacuum in the accumulator to draw fluid waste thereto. In some embodiments, the motor can serve to create positive gas pressure (e.g., using ambient air, other gases, and/or mixtures thereof) to drive fluid waste into the accumulator.

A printing device as described in the present disclosure can have one or more data input mechanisms. Among various embodiments, the one or more data input mechanisms can include one or more input keys, one or more memory media slots, and/or one or more data ports. The printing device can include one or more print media handling components for holding one or more pieces of various embodiments of print media prior to input for printing thereon and/or after printing thereon. In addition, various embodiments of the printing devices described in the present disclosure can include a scanning/copying input and/or one or more display screen user interfaces.

Figure 2A:
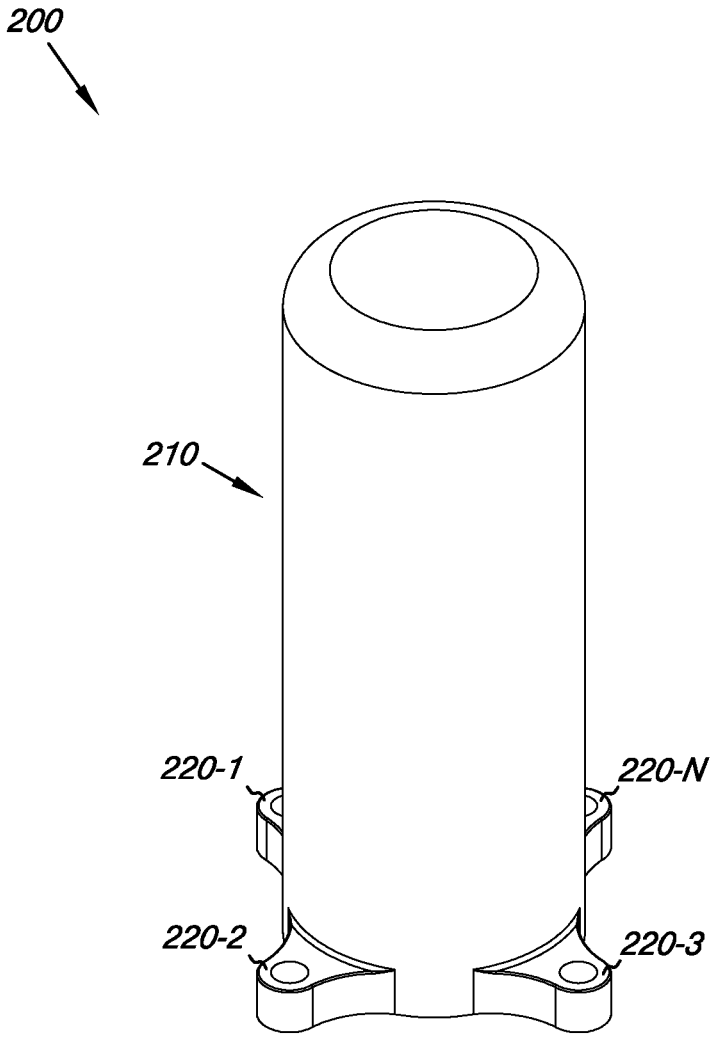
Fig. 2A PRIOR ART
FIGS. 2A and 2B illustrate an example of an accumulator as described in prior disclosures.
Figure 2B:
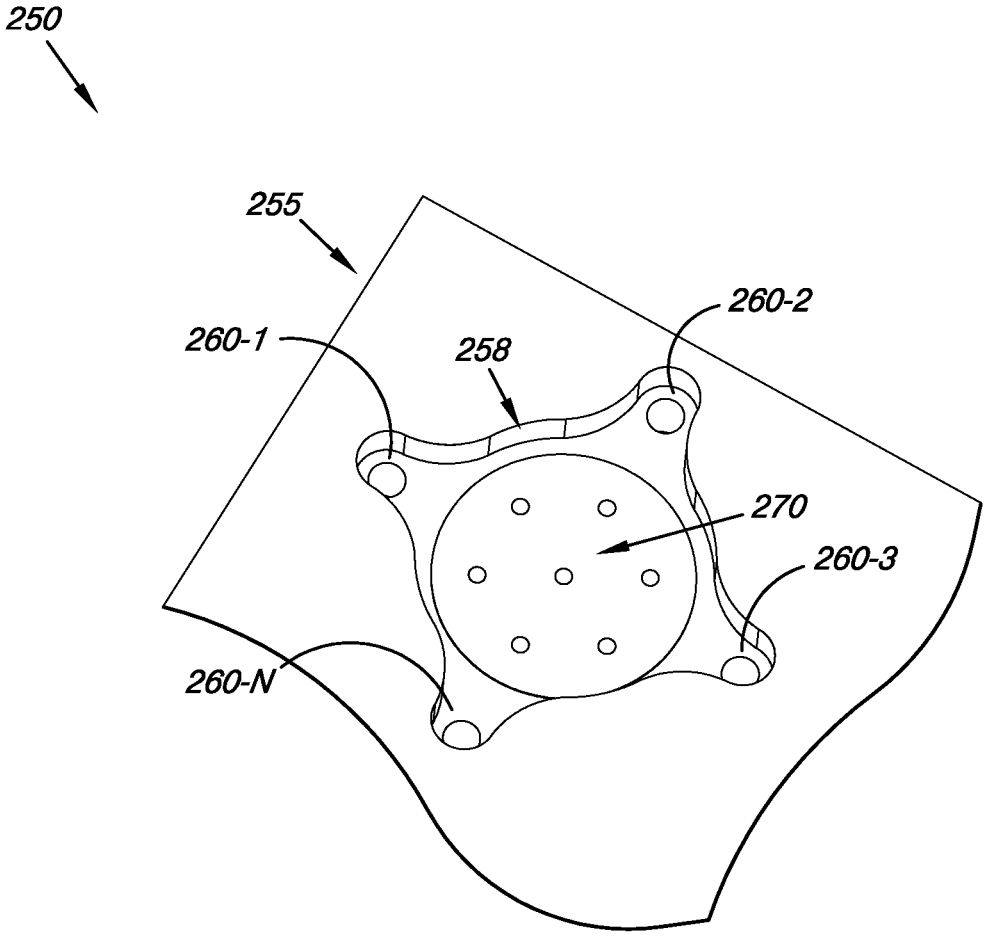
Fig. 2B PRIOR ART

FIGS. 2A and 2B illustrate an example of an accumulator as described in prior disclosures. FIGS. 2A and 2B show a combination of components illustrative of an accumulator used in prior implementations. Using such an accumulator may, however, in some instances, result in substantially solid material in the fluid waste being deposited in the interior of the accumulator, and/or inside/around/near input and/or output orifices thereof, prior to being removed therefrom along with the fluid waste. As such, the deposited solids may reduce the interior volume of the accumulator and/or affect the flow of fluid and/or gas through the orifices.

FIG. 2A illustrates a perspective view of a cap 200 of an accumulator as may be used in prior implementations. In some instances, an axis of, for instance, a hollow cylindrical body 210 of the cap 200 shown in FIG. 2A may be oriented at a right angle to a base 250 of the accumulator, as illustrated in FIG. 2B, although such a configuration is not required for utility and various other configurations have been implemented.

In some instances, a cap 200 such as illustrated in FIG. 2A may be used to contain a partial vacuum created by a pump (not shown) evacuating gas (e.g., air) therefrom. A number of flanges 220-1, 220-2, 220-3, 220-N associated with, for instance, a lower edge of the hollow cylindrical body 210 of the cap 200 may contribute to containing the vacuum by attaching (e.g., with bolts, screws, and/or clamps, among other attachment means) the cap 200 illustrated in FIG. 2A to a base, for instance the base 250 illustrated in FIG. 2B.

FIG. 2B illustrates a perspective view of the base 250 of an accumulator as may be used in prior implementations. In some instances, a surface 255 on which the base 250 of the accumulator is positioned, along with a bottom surface 270 of the accumulator, may be positioned perpendicular to the axis of the hollow cylindrical body 210 of the cap 200 shown in FIG. 2A, although such a configuration is not required for utility and various other configurations have been implemented.

In some instances, as illustrated in FIG. 2B, the surface 255 serving as the base 250 for the accumulator may have a recess 258 into which the cap 200, as illustrated in FIG. 2A, may be attached. Such a recess 258, for instance, may have a number of indentations 260-1, 260-2, 260-3, 260-N into which the flanges 220-1, 220-2, 220-3, 220-N, as illustrated in FIG. 2A, may be inserted. The number of indentations 260-1, 260-2, 260-3, 260-N may, for instance, contribute to containing the vacuum by assisting attachment (e.g., with bolts, screws, and/or clamps, among other mechanisms for attachment) of the cap 200 illustrated in FIG. 2A to the base 250 illustrated in FIG. 2B. Attaching the cap 200 and base 250 of the accumulator as such may, for instance, contribute to containing the vacuum in the accumulator.

An accumulator as used in prior implementations may, for instance, have a bottom surface 270, as illustrated in FIG. 2B, and the bottom surface 270 may have a variable number of perforations. The perforations may serve a range of functions. For instance, a number of the perforations each may be connected through tubing to one or more printheads in order to allow a vacuum contained in the accumulator to withdraw fluid waste therefrom when an appropriate valve in opened.

Such fluid waste may be drawn through the perforations on the bottom surface 270, for instance, by bubbling up through the perforations. The fluid waste collected in the accumulator by passage through the perforations may accumulate, for instance, on the bottom surface 270 for a period of time prior to being withdrawn from the accumulator through, for instance, a different perforation to a waste location (e.g., a diaper) where the fluid waste may be stored.

While the fluid waste is collected above a bottom surface (e.g., the bottom surface 270 illustrated in FIG. 2B), any substantially solid materials transported with the fluid waste into the accumulator may, for instance, settle and/or adhere to a region around an edge of a perforation through which the substantially solid material was introduced into the accumulator. Other locations upon which the substantially solid material may settle and/or to which the substantially solid material may adhere may, for instance, include an interior of tubing used to introduce the fluid waste into the accumulator, valves associated with controlling introduction of the fluid waste, a side wall of the accumulator, and/or any point on the bottom surface of the accumulator, among other locations.

In addition, prior to and/or during removal of the fluid waste from the accumulator through perforations in the bottom surface, the substantially solid material contained therein may, for instance, settle upon and/or adhere to a region around the perforations, especially if such a region is substantially flat. Other locations upon which the substantially solid material may settle and/or to which the substantially solid material may adhere prior to and/or during removal of the fluid waste may, for instance, include an interior of tubing used to remove the fluid waste from the accumulator, valves associated with controlling removal of the fluid waste, a side wall of the accumulator as the level of fluid waste declines, and/or any point on the bottom surface of the accumulator, among other locations.

Allowing such substantially solid waste to settle upon and/or adhere to components associated with the interior of the accumulator may contribute to the substantially solid waste being firmly deposited thereon such that the substantially solid waste remains deposited during current and/or subsequent introduction of fluid waste, for instance, by application of differential gas pressure (e.g., using a partial vacuum and/or positive air pressure). As such, depositing the substantially solid material on components associated with the interior of the accumulator can effectively reduce the interior volume of the accumulator and/or affect the flow of fluid waste and/or gases therethrough.

Reducing the interior volume of an accumulator and/or affecting the flow of fluid waste and/or gases therethrough may, for instance, affect the intensity of a vacuum stored therein such that a pressure differential used to remove excess fluid from the nozzles of the printheads is outside intended design limits. Hence, deposition of substantially solid material in an accumulator, in and/or around perforations thereof, and/or in associated tubing utilized for fluid and/or gas flow may, among other effects, affect the priming of the printheads, possibly contributing to premature failure thereof.

For instance, reducing the interior volume of the accumulator may contribute to a pump with a timed period of operation creating a higher level vacuum (e.g., a lower interior gas pressure) than the priming system (e.g., the valves of the priming system, the tubing between the accumulator and printheads, and/or the nozzles of the printheads, among other components) was designed to accommodate. Applying such a higher vacuum level in, for instance, an attempt to remove excess fluid and/or substantially solid material from nozzles of the printheads may contribute to damaging such components, which may contribute to increased costs for labor and/or parts used in repairing such components.

Hence, reducing the likelihood of depositing substantially solid material in and/or around an accumulator can, for example, reduce costs for labor and/or parts used in repairing components associated with the accumulator and/or increase quality of images printed by a printer by reducing damage that compromises performance of printheads and/or nozzles thereof. As described in the present disclosure, redesigning the configuration of an accumulator can, in various embodiments, reduce the likelihood of depositing substantially solid material in and/or around components of the accumulator.

At least partially reducing the likelihood of substantially solid material being deposited in and/or around an intake orifice (e.g., the outside edge and/or the inside rim of the intake orifice, and/or tubing and/or valves associated with the intake orifice, among other locations) through which the fluid waste is drawn into an accumulator can, in various embodiments, be accomplished by raising the circumference of one or more intake orifices above a level of a surrounding area of the bottom of the accumulator. As described in the present disclosure, attaching a straight and/or upside-down J-shaped snorkel-like component, among other configurations, to an orifice can reduce the likelihood of substantially solid materials contained in fluid waste from settling upon and/or adhering to, for example, the intake orifice and/or associated components after being introduced into the interior of the accumulator.

In addition, using a snorkel-like component, in various embodiments, connected to an orifice used as a vent for controlling gas pressure (e.g., through which gas is removed to create a partial vacuum and/or through which gas is introduced to create positive pressure) can reduce the likelihood of substantially solid materials contained in fluid waste from settling upon and/or adhering to the vent orifice and/or associated components after being introduced into the interior of the accumulator.

As such, using a snorkel-like component as described in the present disclosure can, for example, reduce the likelihood of deposited substantially solid material affecting intake of further fluid waste and/or substantially solid material contained therein. Such a snorkel-like component can, in some embodiments, also reduce the likelihood of deposited substantially solid material affecting removal and/or introduction of gas (e.g., air, nitrogen, oxygen, water vapor, and/or combinations thereof, among others) used to control intake of fluid waste and/or substantially solid materials through the one or more input orifices and/or removal of such through the one or more output orifices.

However, attaching a snorkel-like component to the one or more output orifices, although reducing the likelihood of substantially solid material being deposited in and/or around such orifices and associated components, can be ineffective in contributing to maintaining a substantially stable interior volume of an accumulator (e.g., reducing the likelihood of the interior volume being reduced by deposition of substantially solid materials). That is, attaching a snorkel-like component to an output orifice can, in some embodiments, result in an effective opening of the output orifice being raised above the bottom surface of the accumulator, which can reduce the output orifice's ability to remove fluid waste and/or substantially solid material when a level of such fluid waste and/or substantially solid material falls below the level of the effective opening of the output orifice having the attached snorkel-like component.

Hence, one or more output orifices attached individually or as a group to one or more snorkel-like components can exacerbate deposition of substantially solid material on the bottom of an accumulator by reducing the ability of the output orifices to thoroughly remove fluid waste and/or substantially solid material introduced through the input orifices. As such, implementing attachment of snorkel-like components to output orifices can, in some embodiments, reduce rather than increase the likelihood of maintaining a substantially stable interior volume of an accumulator.

Figure 3A:
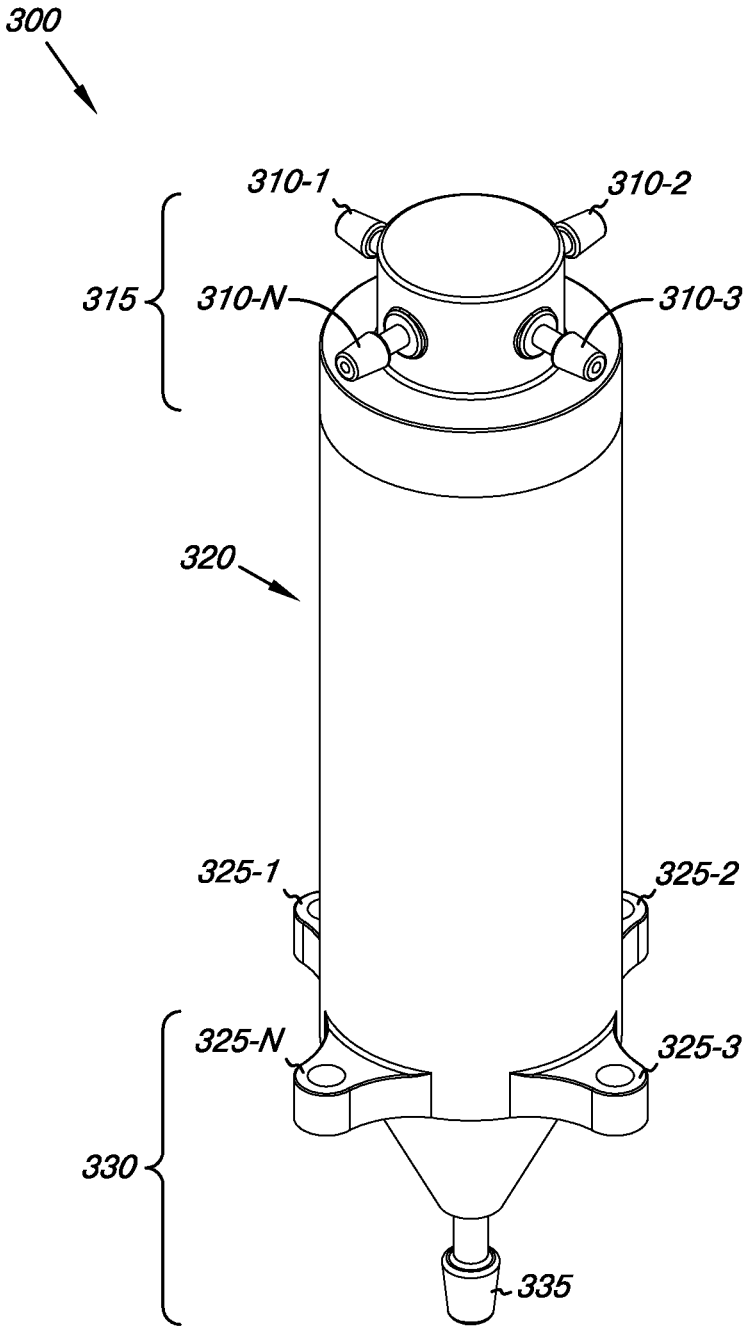
FIG. 3A illustrates an embodiment of an accumulator according to embodiments of the present disclosure.

FIG. 3A illustrates an embodiment of an accumulator according to embodiments of the present disclosure. FIG. 3A illustrates that the components described in various embodiments of the present disclosure can be included in a single embodiment of an accumulator 300. However, the embodiment of the accumulator 300 illustrated in FIG. 3A is shown by way of example and not by way of limitation.

That is, various features are grouped together in a single embodiment for the purpose of streamlining the disclosure. This method of disclosure is not to be interpreted as reflecting an intention that the disclosed embodiment illustrated in FIG. 3A represents a need for a specific number and/or shape of the various components (e.g., input and/or output orifices, among other components) and/or inclusion of such features unless such a combined configuration is expressly recited in the broadest independent claim of the present disclosure.

The accumulator illustrated in FIG. 3A shows a number of input orifices 310-1, 310-2, 310-3, 310-N positioned in a number of locations associated with a top region 315 of the accumulator 300. The embodiment of the accumulator 300 illustrated in FIG. 3A shows four input orifices 310-1, 310-2, 310-3, 310-N evenly spaced in a circular arrangement and extending out substantially perpendicular to a vertical axis of the accumulator 300.

However, an accumulator as described in the present disclosure can, in various embodiments, have variable numbers of input orifices associated with the top region and the positioning and/or angle of input of each input orifice into the top region of the accumulator can vary depending on a number of considerations. For example, the number of printheads having fluid waste withdrawn by each input orifice, which can, in various embodiments, be one or more, and/or space limitations in the environs of the accumulator, among other considerations, can affect the number and/or configuration of the input orifices.

In various embodiments, an accumulator as described in the present disclosure can include one or more orifices in the top region that function as vents for controlling gas pressure. As such, the one or more orifices functioning as vents can be directly and/or indirectly connected to one or more motors functioning as a pump for creating a partial vacuum within the accumulator, and/or directly or indirectly to one or more motors functioning as blowers and/or one or more gas sources (e.g., tanks of compressed gas) to create positive gas pressure within the accumulator and/or within printheads connected by tubing to input orifices of the accumulator, among other functions and/or connections related to the vent orifice.

The top region 315 of the embodiment of the accumulator 300 illustrated in FIG. 3A is shown to be connected to and positioned atop a vertically oriented cavity 320 of the accumulator 300. Among various embodiments as described in the present disclosure, the vertically oriented cavity 320 can be substantially cylindrical, as shown in FIG. 3A. However, as appreciated by one of ordinary skill in the relevant art, a vertically oriented cavity can have a variety of cross-sectional shapes, and relative heights versus widths, among other dimensional considerations.

Being a vertically oriented cavity is defined by the input orifices in the top region being above the internal cavity of the accumulator, where the internal cavity in turn is above a number of output orifices in a bottom region of the accumulator, as described in the present disclosure. With regard to the present disclosure, the terms "above", "top", "below", "bottom", and equivalents thereof, are used with reference to a direction of gravitational pull, for example, on the fluid waste and/or the substantially solid material portion thereof.

In some embodiments, a number of flanges 325-1, 325-2, 325-3, 325-N can, in various embodiments, form a portion of and/or be attached to a number of locations on the outside of the vertically oriented cavity 320, as illustrated in FIG. 3A. The flanges 325-1, 325-2, 325-3, 325-N, for example, as shown on the accumulator 300 can, in various embodiments, be used for installation and/or attachment of the accumulator 300 into an apparatus and/or system (not shown) in which the accumulator is intended to function and/or onto a chassis thereof, among other locations.

Flanges, for example, as shown in FIG. 3A can assist in maintaining the vertically oriented cavity 320, and other components attached to the vertically oriented cavity 320, in a fixed and upright orientation relative to the gravitational pull. In some embodiments, various numbers of flanges can be placed in locations in addition to and/or in place of the flanges 325-1, 325-2, 325-3, 325-N illustrated in FIG. 3A. That is, some flanges can be connected to various locations on the top region 315, some flanges can be connected to various locations on the outside of the vertically oriented cavity 320 other than those illustrated in FIG. 3A, and/or some flanges can be connected to various locations on a bottom region 330 of the accumulator 300.

As illustrated in the embodiment shown in FIG. 3A, the bottom region 330 of the accumulator 300 can, in various embodiments, be connected to and positioned below the vertically oriented cavity 320 of the accumulator 300. As described in the present disclosure, a bottom region of an accumulator can, in various embodiments, include a number of (i.e., one or more) output orifices allowing for removal of fluid waste and/or substantially solid material introduced into the accumulator through input orifices associated with the top region of the accumulator.

Accordingly, as illustrated in the embodiment shown in FIG. 3A, an output orifice 335 can be provided for the fluid waste in a bottom region 330 of the vertically oriented cavity 320 in the accumulator 300. Some embodiments, as illustrated in FIG. 3A, can include a substantially conical section of the bottom region 330 to direct the fluid waste toward the output orifice 335. A substantially conical configuration of a bottom region of an accumulator can reduce the likelihood of substantially solid material input to the accumulator in fluid waste from settling on and/or adhering to areas of a bottom region distal to an output orifice through which the substantially solid material can be removed.

As such, the substantially conical configuration can, in various embodiments, reduce the likelihood of the substantially solid material being deposited in an accumulator and, for example, reducing the interior volume of the accumulator. Hence, one or more substantially conical sections of the bottom region can, in various embodiments, direct the fluid waste, along with substantially solid material carried therein, into tubing connected to the output orifice, in some embodiments, where the tubing can direct the fluid waste to a distal waste receptacle (e.g., a diaper).

In some implementations, an accumulator as described in the present disclosure can, in various embodiments, be utilized in a printing device. In such an implementation, a number of input orifices can be used for receiving fluid waste from within the printing device, where the number of input orifices is in a top region of a vertically oriented cavity in the accumulator. As such, the number of input orifices for fluid waste can, in various embodiments, receive fluid waste obtained from nozzles of a number of printheads in the printing device.

Figure 3B:
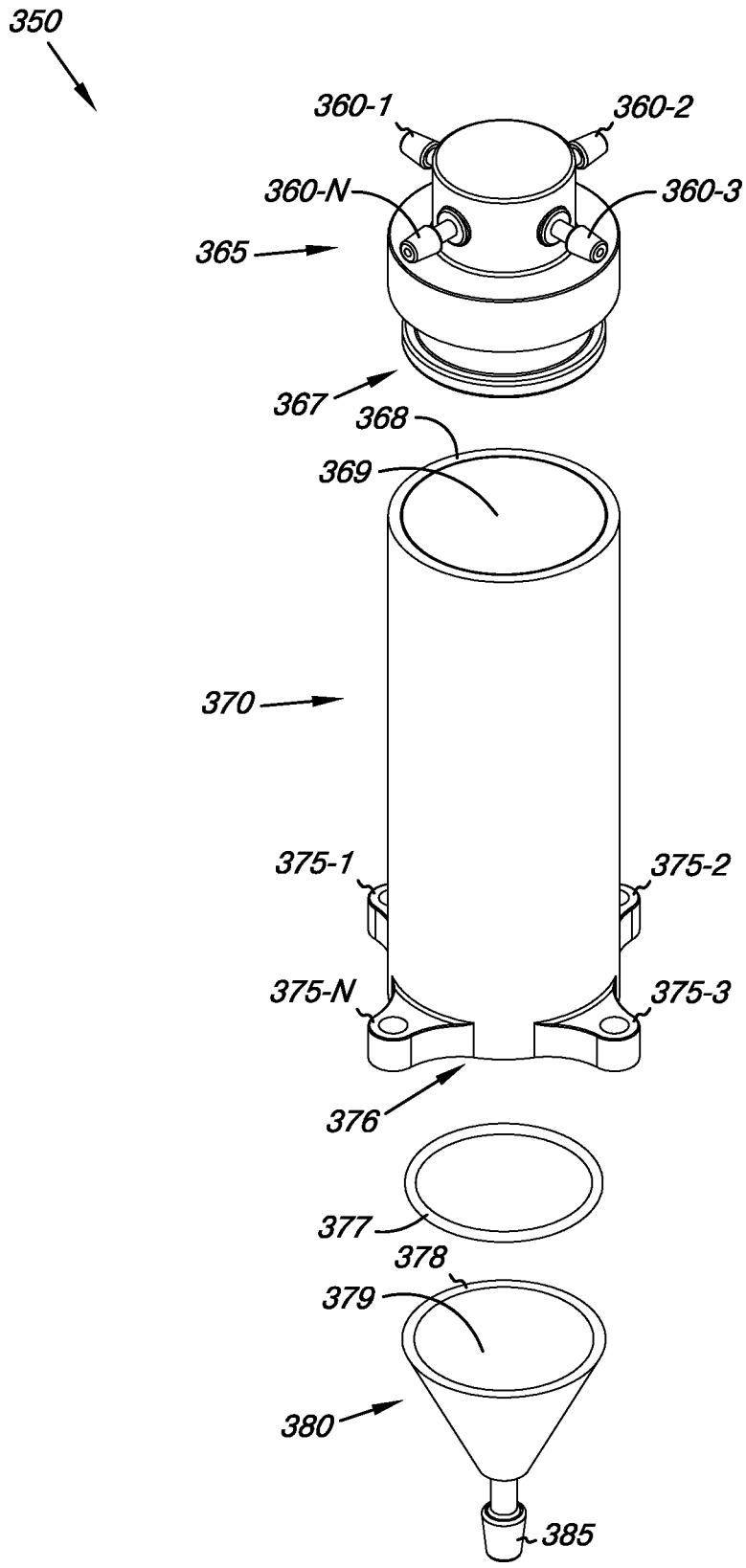
FIG. 3B illustrates an expanded view of components of the embodiment of FIG. 3A according to embodiments of the present disclosure.

FIG. 3B illustrates an expanded view of components of the embodiment of FIG. 3A according to embodiments of the present disclosure. FIG. 3B illustrates that the components described in various embodiments of the present disclosure, for example, as illustrated in FIG. 3A, can be separated into a number of individual components of an accumulator 350. However, the embodiment of the accumulator 350 illustrated in FIG. 3B is shown by way of example and not by way of limitation.

That is, as in the description of FIG. 3A, various features are grouped together in the expanded embodiment for the purpose of streamlining the disclosure. Once again, this method of disclosure is not to be interpreted as reflecting an intention that the disclosed embodiment illustrated in FIG. 3B represents a need for a specific number and/or shape of the various components (e.g., input and/or output orifices, among other components) and/or inclusion of such features unless such a combined configuration is expressly recited in the broadest independent claim of the present disclosure.

The accumulator 350 illustrated in FIG. 3B shows a number of input orifices 360-1, 360-2, 360-3, 360-N positioned in a number of locations associated with a top region 365 of the accumulator 350. However, as described with regard to FIG. 3A, an accumulator can, in various embodiments, have variable numbers of input orifices associated with the top region and the positioning and/or angle of input of each input orifice into the top region of the accumulator can vary depending on a number of considerations.

The top region 365 of the embodiment of the accumulator 350 illustrated in FIG. 3B is shown to be connectable to a vertically oriented cavity 370 of the accumulator 350 in a position atop the vertically oriented cavity 370. Among various embodiments as described in the present disclosure, the vertically oriented cavity 370 can be substantially cylindrical, as shown in FIG. 3B. However, as described with regard to FIG. 3A, a vertically oriented cavity can have a variety of cross-sectional shapes, and relative heights versus widths, among other dimensional considerations.

A top region of an accumulator, as described in the present disclosure, can be connected to, in various embodiments, a vertically oriented cavity of the accumulator. By way of example and not by way of limitation, FIG. 3B illustrates that the top region 365 can be connected to the vertically oriented cavity by inserting an extension 367 of the top region 365 into an upper rim 368 of the vertically oriented cavity 370 so as to penetrate partway into the interior 369 of the vertically oriented cavity 370. The top region 370 can be attached to the vertically oriented cavity by way of a number of arrangements, as appreciated by one of ordinary skill in the relevant art (e.g., by way of adhesive, one or more clamps, with assistance from an O-ring, and/or tightening a band around the top of the vertically oriented cavity, among other arrangements). In some embodiments, the top region 370 can be securely attached to the vertically oriented cavity 370 so as to reduce leakage of gas into and/or out of the vertically oriented cavity 370.

As described with regard to FIG. 3A, a number of flanges 375-1, 375-2, 375-3, 375-N can, in various embodiments, form a portion of and/or be attached to a number of locations on the outside of the vertically oriented cavity 370, as illustrated in FIG. 3B. The flanges 375-1, 375-2, 375-3, 375-N, for example, as shown on the accumulator 350 can, in various embodiments, be used for installation and/or attachment of the accumulator 350 into an apparatus and/or system (not shown) in which the accumulator is intended to function and/or onto a chassis thereof, among other locations. In addition, flanges can assist in maintaining a separable vertically oriented cavity 370, and other components attached to the vertically oriented cavity 370, in a fixed and upright orientation relative to a bottom region 380 of the accumulator 350.

In some embodiments, the vertically oriented cavity 370, and other components attached to the vertically oriented cavity 370 (e.g., the top region 365) can, for example, be installable and/or removable from the apparatus and/or system (not shown). In some embodiments, such an apparatus and/or system can, in various embodiments, have the bottom region 380 of the accumulator 350, for example, inserted into and/or attached to structural elements of the apparatus. The flanges 375-1, 375-2, 375-3, 375-N can, for example, be used to attach the vertically oriented cavity 370, and other components attached to the vertically oriented cavity 370, to such a structural element so that an opening 376 in a lower portion of the vertically oriented cavity 370 is stably positioned above the bottom region 380 of the accumulator 350.

As illustrated in the embodiment shown in FIG. 3B, the opening 376 in the lower portion of the vertically oriented cavity 370 of the accumulator 350 can, in various embodiments, be connected to (e.g., with assistance from an O-ring 377, by way of adhesive, one or more clamps, and/or tightening a band around the top of the vertically oriented cavity, among other arrangements) and positioned above an upper rim 378 of the bottom region 380. In some embodiments, the bottom region 380 can be securely attached to the vertically oriented cavity 370 so as to reduce leakage of gas into and/or out of the vertically oriented cavity 370.

Connecting the vertically oriented cavity 370 as such can, for example, allow an inner wall of the opening 376 in the lower portion of the vertically oriented cavity 370 to converge with an inner wall 379 of the bottom region 380. In some embodiments, such a convergence of the inner wall of the opening 376 in the vertically oriented cavity 370 and the inner wall 379 of the bottom region 380 can provide a smooth transition that reduces the likelihood of substantially solid material from being deposited thereon. Such a smooth transition can, in various embodiments, assist in directing fluid waste and/or substantially solid material to one or more output orifices, for example, the output orifice 385 illustrated at the bottom of the conical section of the bottom region 380 as illustrated in FIG. 3B.

Executable instructions usable in accomplishing the functions described in the present disclosure for managing substantially solid material in fluid waste can, in various embodiments, be stored using a variety of storage implementations. For example, the functions described herein can be performed using logic, software, firmware, hardware, application modules, and ASICs, or combinations of these elements, and the like, to perform the operations described herein. Embodiments as described herein are not limited to any particular operating environment or to software/firmware coded and stored in a particular programming language.

The elements described can be resident on the systems, apparatuses, and/or devices described herein, or otherwise. Logic suitable for performing embodiments of the present disclosure can be resident in one or more devices and/or locations. Processing devices used to execute operations described herein can include one or more individual modules that perform a number of functions, separate modules connected together, and/or independent modules.

In implementations in which one or more accumulators as described in the present disclosure are utilized in a printing device, executable instructions can be used to sense that a number of printheads in the print device are in condition for priming for a print job. For example, the executable instructions can direct sensing that the number of printheads are located in a service station having caps corresponding to positions of a number of nozzles in the number of printheads and/or that a test print indicates that one or more nozzles of particular printheads are being affected by substantially solid material located in and/or near the nozzle opening, among other indicators for priming of printheads in a printing device.

The executable instructions can be used to initiate priming the number of printheads, where priming can, in various embodiments, include clearing fluid and/or substantially solid material, collectively termed fluid waste, therefrom. Execution of the instructions can involve collecting the fluid waste in an accumulator, where the accumulator can include, in various embodiments, a number of output orifices for the substantially solid material in the fluid waste in a bottom region of a vertically oriented cavity in the accumulator.

Executable instructions can be performed to remove the substantially solid material from the bottom region of the vertically oriented cavity in the accumulator in various embodiments. In some embodiments, removing the substantially solid material from the bottom region of the vertically oriented cavity in the accumulator can include removing the fluid along with the substantially solid material. Removing the substantially solid material can include removing the substantially solid material to, in various embodiments, a distal waste receptacle (e.g., a diaper).

Executable instructions can, in various embodiments, be used to control priming the number of printheads, clearing fluid waste therefrom, collecting the fluid waste in the accumulator, and/or removing the substantially solid material to the distal waste receptacle by controlling opening and closing a number of valves in a circuit of tubing. The circuit of tubing can be used to connect the operable components of a priming system, for example, the accumulator, the pump, the waste receptacle, and/or various orifices associated therewith, among other components.

In some embodiments, controlling opening and/or closing the number of valves in the circuit of tubing can, in various embodiments, include controlling application of a vacuum for priming, clearing, collecting, and/or removing the substantially solid material. In some embodiments, controlling opening and/or closing the number of valves in the circuit of tubing can, in various embodiments, include controlling application of positive of gas (e.g., air, nitrogen, oxygen, water vapor, and/or combinations thereof, among others) pressure for priming, clearing, collecting, and/or removing the substantially solid material.

For example, to initiate priming of one or more printheads in a printing device, valves associated with input and output orifices of an accumulator can be directed to close in order to facilitate creation of a partial vacuum in the accumulator. Valves associated with the one or more vent orifices can be directed to remain open to allow, for example, a pump to withdraw gas from the accumulator until an intended level of vacuum (e.g., negative gas pressure relative to ambient air pressure) is achieved. When the intended level of vacuum is achieved within the accumulator, the valves associated with the vent orifices can be directed to close in order to maintain the vacuum within the accumulator.

When withdrawal of excess fluid and/or substantially solid material (i.e., fluid waste) from the printheads and/or nozzles thereof is intended to begin (e.g., when the printheads are appropriately positioned in a service station), valves associated with input orifices can be directed to open while keeping other valves closed. By doing so, the partial vacuum contained in the accumulator can cause the fluid waste to be withdrawn from the printheads and/or nozzles thereof and to be transported (e.g., through tubing connections) into the accumulator through the input orifices.

When removal of the fluid and/or substantially solid material of the fluid waste from the accumulator is intended to begin, valves associated with output orifices can be directed to open. By doing so, the fluid waste contained in the accumulator can be removed therefrom and transported (e.g., through tubing connections) to a distal waste receptacle (e.g., a diaper) by flow through the output orifices.

In some embodiments, the valves associated with the input orifices and/or the vent orifices can also be directed to open to release vacuum when removing the fluid waste from the accumulator. In some embodiments, valves associated with the input orifices can be directed to close while valves associated with vent orifices are directed to open in order to allow flow of positive gas pressure (e.g., provided by a blower, and/or pressurized gas, among other ways of inputting positive gas pressure) into the accumulator to assist in causing the fluid waste to be removed from the accumulator by flowing through the output orifices.

Figure 4:
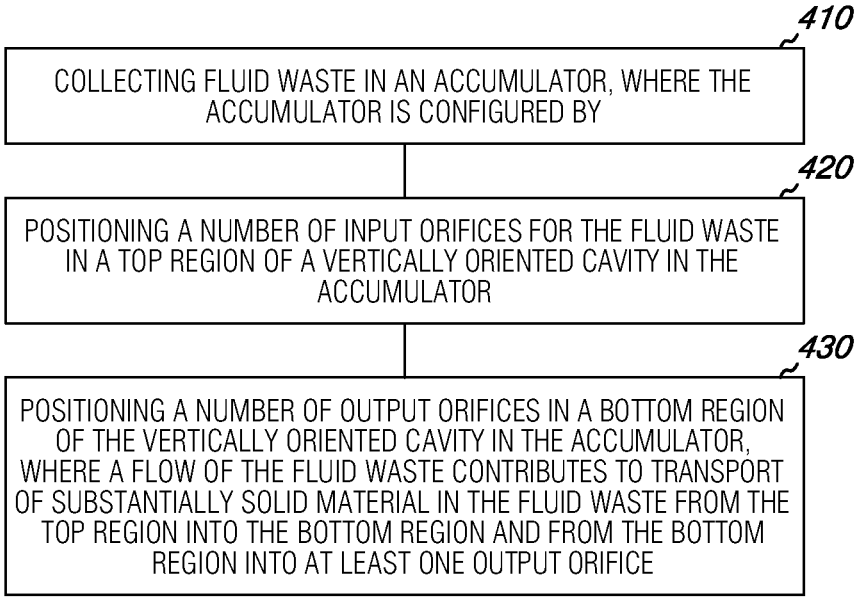
FIG. 4 is a block diagram illustrating a method of managing solids in fluid waste according to an embodiment of the present disclosure.

FIG. 4 is a block diagram illustrating a method of managing solids in fluid waste according to an embodiment of the present disclosure. Unless explicitly stated, the method embodiments described herein are not constrained to a particular order or sequence. Additionally, some of the described method embodiments, or elements thereof, can occur or be performed at the same, or at least substantially the same, point in time.

The embodiment illustrated in FIG. 4 includes collecting fluid waste in an accumulator, where the accumulator can be configured in a number of particular embodiments, as shown in block 410. In various embodiments, the accumulator can be configured by positioning a number of input orifices for the fluid waste in a top region of a vertically oriented cavity in the accumulator, as shown in block 420. As described in the present disclosure, various numbers of input orifices and/or location/positioning thereof can be used in various embodiments, for example, depending on the number of printheads connected to each input orifice, fluid waste flow dynamics, and/or structural limitations of the environs of the accumulator, among other possible considerations.

As shown in block 430, a number of output orifices can be positioned in a bottom region of the vertically oriented cavity in the accumulator, where a flow of the fluid waste can contribute to transport of substantially solid material in the fluid waste from the top region into the bottom region and from the bottom region into at least one output orifice. In some embodiments of the present disclosure, one or more substantially conical sections of the bottom region can, in various embodiments, contribute to transport of the substantially solid material in the fluid waste, and thereby reduce the likelihood of deposition thereof, by directing the fluid waste and/or the substantially solid material to a particular output orifice located at or near the bottom of each conical section.

Additionally, positioning the number of input orifices for the fluid waste in the top region of the vertically oriented cavity can, in various embodiments, enable settling of the substantially solid material in the fluid waste into the bottom region of the vertically oriented cavity in the accumulator. That is, gravitational pull along the axis of the vertically oriented cavity can contribute moving the fluid waste and/or the substantially solid material from the top region through the vertically oriented cavity to the bottom region of the accumulator.

As described in the present disclosure, removing the substantially solid material from the bottom region of the vertically oriented cavity in the accumulator, in various embodiments, can reduce deposition of the substantially solid material in the accumulator. Hence, removing the substantially solid material from the bottom region of the vertically oriented cavity in the accumulator can contribute to maintaining a substantially stable interior volume of the accumulator.

Accordingly, reducing deposition of the substantially solid material in the accumulator can contribute to maintaining a substantially stable gas pressure differential by maintaining the substantially stable interior volume of the vertically oriented cavity. In some embodiments, the substantially stable gas pressure differential can be utilized as a substantially stable vacuum to pull the fluid waste into the accumulator, where the vacuum is produced by a pump. In some embodiments, the substantially stable gas pressure can, for example, be utilized to facilitate using positive gas pressure to push the liquid waste into the accumulator.

In some implementations, collecting fluid waste in an accumulator as described in the present disclosure can, in various embodiments, be used for collecting colorant in the accumulator from a number of printheads of a printing device. In such implementations, collecting colorant in the accumulator from the printheads can, in various embodiments, be used for priming the printheads for subsequent printing of a print request.

Although specific embodiments have been illustrated and described herein, those of ordinary skill in the relevant art will appreciate that an arrangement calculated to achieve the same techniques can be substituted for the specific embodiments shown. This disclosure is intended to cover all adaptations or variations of various embodiments of the present disclosure.

It is to be understood that the above description has been made in an illustrative fashion, and not a restrictive one. Combination of the above embodiments, and other embodiments not specifically described herein, will be apparent to those of ordinary skill in the relevant art upon reviewing the above description.

The scope of the various embodiments of the present disclosure includes other applications in which the above structures and methods are used, for example, in implementations other than printing devices. Therefore, the scope of various embodiments of the present disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the disclosed embodiments of the present disclosure need to use more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. An accumulator, comprising:

a number of input orifices for receiving fluid waste from within a printing device, where the number of input orifices is in a top region of a vertically oriented cavity in the accumulator;

an output orifice for the fluid waste in a bottom region of the vertically oriented cavity in the accumulator; and a conical section of the bottom region to direct the fluid waste toward the output orifice.

2. The device of claim 1, where the accumulator includes at least one orifice in the top region that functions as a vent for controlling gas pressure.

3. The device of claim 1, where the vertically oriented cavity is substantially cylindrical.

4. The device of claim 1, where the number of input orifices for fluid waste receives fluid waste obtained from nozzles of a number of printheads in the printing device.

5. The device of claim 1, where the conical section of the bottom region directs the fluid waste, along with substantially solid material carried therein, into tubing connected to the output orifice, where the tubing directs the fluid waste to a distal waste receptacle.

6. The device of claim 1, wherein the top and bottom regions are oriented in a direction of gravitational pull.

7. The device of claim 1, wherein the top region is connected to the vertically oriented cavity by inserting an extension of the top region into an upper rim of the vertically oriented cavity.

8. The accumulator of claim 1, further comprising:

at least one orifice in the top region that functions as a vent for controlling gas pressure of the accumulator;

wherein the number of input orifices and the at least one orifice that functions as a vent are arranged in a circular arrangement around the top region and extending out from the top region perpendicular to a vertical axis of the vertically oriented cavity.

9. The device of claim 4, wherein the fluid waste comprises colorant from the printheads in the printing device.

10. The device of claim 9, further comprising one or more flanges for attachment of the device into the printing device.

11. A printing device, comprising:

a chassis;

a print engine comprising a number of printheads and supported by the chassis;

an accumulator attached to the chassis, wherein the accumulator comprises:

a number of input orifices for receiving fluid waste from within a printing device, where the number of input orifices is in a top region of a vertically oriented cavity in the accumulator;

an output orifice for the fluid waste in a bottom region of the vertically oriented cavity in the accumulator; and a conical section of the bottom region to direct the fluid waste toward the output orifice.

12. The printing device of claim 11, where the accumulator further includes at least one orifice in the top region that functions as a vent for controlling gas pressure.

13. The printing device of claim 11, where the number of input orifices for fluid waste receives fluid waste obtained from nozzles of the number of printheads.

14. The printing device of claim 11, where the conical section of the bottom region directs the fluid waste, along with substantially solid material carried therein, into tubing connected to the output orifice, where the tubing directs the fluid waste to a distal waste receptacle.

15. The printing device of claim 11, wherein the top and bottom regions are oriented in a direction of gravitational pull.

16. The printing device of claim 11, further comprising valves associated with the input orifices.

17. A printing device, comprising:

a chassis;

a print engine comprising a number of printheads and supported by the chassis;

an accumulator attached to the chassis, wherein the accumulator comprises:

a number of input orifices for receiving fluid waste from the number of printheads, where the number of input orifices is in a top region of a vertically oriented cavity in the accumulator, and where the fluid waste comprises colorant from the number of printheads;

at least one orifice in the top region that functions as a vent for controlling gas pressure of the accumulator;

an output orifice for the fluid waste in a bottom region of the vertically oriented cavity in the accumulator; and a conical section of the bottom region to direct the fluid waste toward the output orifice.

18. The printing device of claim 17, where the conical section of the bottom region directs the fluid waste, along with substantially solid material carried therein, into tubing connected to the output orifice, where the tubing directs the fluid waste to a distal waste receptacle.

19. The printing device of claim 17, wherein the top and bottom regions are oriented in the chassis of the printing device in a direction of gravitational pull.

20. The printing device of claim 17, wherein the number of input orifices and the at least one orifice that functions as a vent are arranged in a circular arrangement around the top region and extending out from the top region perpendicular to a vertical axis of the vertically oriented cavity, and wherein the at least one orifice that functions as a vent is configured to generate a pressure differential between the number of printheads and the accumulator.

* * * * *